US008081114B2

(12) United States Patent
Stuart

(10) Patent No.: US 8,081,114 B2
(45) Date of Patent: Dec. 20, 2011

(54) STRIP-ARRAY ANTENNA

(75) Inventor: Howard R. Stuart, Glen Ridge, NJ (US)

(73) Assignee: Alcatel Lucent, Paris (FR)

( * ) Notice: Subject to any disclaimer, the term of this patent is extended or adjusted under 35 U.S.C. 154(b) by 1046 days.

(21) Appl. No.: 11/938,533

(22) Filed: Nov. 12, 2007

(65) Prior Publication Data

US 2008/0258978 A1 Oct. 23, 2008

Related U.S. Application Data

(60) Provisional application No. 60/925,813, filed on Apr. 23, 2007.

(51) Int. Cl.
*H01Q 1/38* (2006.01)

(52) U.S. Cl. ..... 343/700 MS

(58) Field of Classification Search ..... 343/700 MS, 343/893, 749, 751, 752, 846, 909, 789, 793
See application file for complete search history.

(56) References Cited

U.S. PATENT DOCUMENTS

| | | | | |
|---|---|---|---|---|
| 4,291,312 | A * | 9/1981 | Kaloi | 343/700 MS |
| 5,576,718 | A * | 11/1996 | Buralli et al. | 343/700 MS |
| 6,211,824 | B1 * | 4/2001 | Holden et al. | 343/700 MS |
| 6,281,843 | B1 * | 8/2001 | Evtioushkine et al. | 343/700 MS |
| 6,285,325 | B1 | 9/2001 | Nalbandian et al. | 343/700 |
| 6,549,169 | B1 * | 4/2003 | Matsuyoshi et al. | 343/702 |
| 6,680,712 | B2 * | 1/2004 | Yamamoto et al. | 343/789 |
| 6,870,514 | B2 * | 3/2005 | Simpson | 343/846 |
| 7,710,324 | B2 * | 5/2010 | Tatarnikov et al. | 343/700 MS |
| 2005/0116875 | A1 * | 6/2005 | Yuanzhu et al. | 343/846 |
| 2006/0044189 | A1 * | 3/2006 | Livingston et al. | 343/700 MS |

FOREIGN PATENT DOCUMENTS

| | | | |
|---|---|---|---|
| EP | 1 684 381 | A1 | 7/2006 |
| JP | 10-070411 | | 10/1998 |
| WO | WO0249146 | A2 * | 6/2002 |
| WO | WO2005117208 | A1 * | 8/2005 |

OTHER PUBLICATIONS

"Design of Compact Planar Antennas using LH-Transmission Lines," Martin Schüβler et al., Microwave Symposium Digest, TU3C-4, IEEE MTT-S Digest, vol. 1, Germany, Jun. 6-11, 2004, pp. 209-212, XP10727265.

Japanese Office Action; Mailed Oct. 12, 2011 for the corresponding JP Application No. JP 2010-506214.

* cited by examiner

*Primary Examiner* — Jacob Y Choi
*Assistant Examiner* — Robert Karacsony
(74) *Attorney, Agent, or Firm* — Mendelsohn, Drucker & Associates, P.C.; Yuri Gruzdkov; Steve Mendelsohn

(57) ABSTRACT

A representative embodiment of the invention provides an antenna having an electrically conducting ground plane and an array of electrically conducting strips located at an offset distance from the ground plane. Electrically conducting pathways, each attached to the middle portion of the corresponding strip, connect the strips to the ground plane. Electrically conducting lips, each attached to an edge of the corresponding conducting strip, extend about halfway toward the ground plane. The size of the array is smaller than the wavelength of the fundamental radiation mode supported by the antenna. Advantageously, the antenna has a bandwidth about three times larger than that of a comparably sized prior-art patch antenna.

10 Claims, 12 Drawing Sheets

200

200

100

100

410

420

430

440

900

900

1100

STRIP-ARRAY ANTENNA

CROSS-REFERENCE TO RELATED APPLICATIONS

This application claims priority from U.S. Provisional Patent Application No. 60/925,813 filed Apr. 23, 2007, the teachings of which are incorporated herein by reference.

BACKGROUND OF THE INVENTION

1. Field of the Invention

The present invention relates to radio-electronics and, more specifically, to antennas for radio transceivers.

2. Description of the Related Art

With the continuing development of wireless communication systems, conventional wire-line transmissions are gradually yielding to or being supplemented by wireless transmissions. Many portable electronic data processors, such as laptop computers and personal digital assistants, are now using wireless communication methods to transmit and receive data. In addition, there has been a marked increase in the use of cellular and cordless phones.

One general problem in the design of a portable wireless communication device is associated with its antenna. When an external dipole or monopole structure is used as an antenna, it can typically be easily broken during normal use. Also, the cost of incorporating an external antenna and its conduits into the device can add considerably to the cost of the final product. For at least some of these reasons, wireless equipment manufacturers often use planar (e.g., patch) antennas instead of or in addition to external antennas.

A conventional patch antenna is often manufactured by forming a conducting ground plane at one side of a printed circuit board and a conducting patch at the other side of the board. However, one problem with this antenna structure is that it has a relatively narrow bandwidth due to its highly resonant characteristics. Unfortunately, known methods for increasing the bandwidth of a patch antenna without increasing its size are relatively complicated and/or generally not conducive to use in mass production.

SUMMARY OF THE INVENTION

A representative embodiment of the invention provides an antenna having an electrically conducting ground plane and an array of electrically conducting strips located at an offset distance from the ground plane. Electrically conducting pathways, each attached to the middle portion of the corresponding strip, connect the strips to the ground plane. Electrically conducting lips, each attached to an edge of the corresponding conducting strip, extend about halfway toward the ground plane. The size of the array is smaller than the wavelength of the fundamental radiation mode supported by the antenna. Advantageously, the antenna has a bandwidth about three times larger than that of a comparably sized prior-art patch antenna.

According to one embodiment, an antenna of the invention comprises (1) an electrically conducting surface; and (2) an array having two or more electrically conducting strips located at an offset distance from the conducting surface, said two or more conducting strips separated from one another by one or more gaps. A combined width of a conducting strip and an adjacent gap is smaller than the wavelength of a fundamental radiation mode of the antenna.

According to another embodiment, an antenna of the invention comprises a conducting tube. A first side of the tube has a slot oriented along a longitudinal axis of the tube, said slot creating first and second edges in the first side. The antenna further comprises a first conducting lip attached to the first edge and extending toward a second side of the tube.

BRIEF DESCRIPTION OF THE DRAWINGS

Other aspects, features, and benefits of the present invention will become more fully apparent from the following detailed description, the appended claims, and the accompanying drawings in which:

DETAILED DESCRIPTION

Figure 1A:
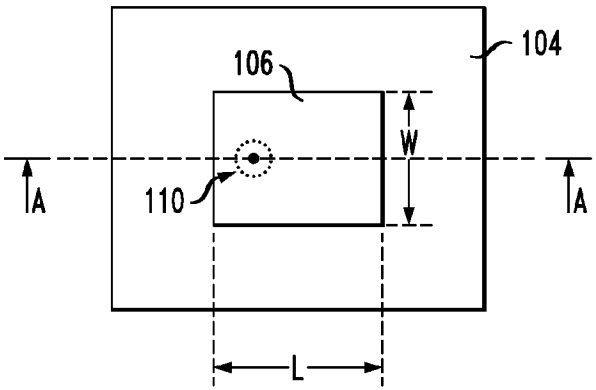
FIG. 1A PRIOR ART
FIGS. 1A-B show top and cross-sectional side views, respectively, of a prior-art patch antenna.
Figure 1B:
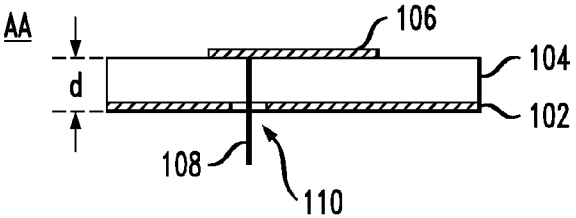
FIG. 1B PRIOR ART

Patch Antenna:

FIGS. 1A-B show top and cross-sectional side views, respectively, of a prior-art patch antenna 100. Antenna 100 has a flat rectangular conductor (patch) 106 of length L and width W placed at a relatively small offset distance (d) from a conducting ground plane 102. Patch 106 is supported by a dielectric substrate 104 having electric permittivity $\epsilon$. A conducting probe (wire) 108 fed through an opening 110 in ground plane 102 couples patch 106 to an external transmission line (not explicitly shown). Probe 108 does not have a direct electrical contact with ground plane 102.

A drive signal applied via probe 108 to patch 106 can excite a mode oscillating across its length L and/or width W. Assuming that L is greater than W, the fundamental mode (which is of primary interest in the antenna design) is the mode oscillating across length L. With respect to this mode, antenna 100 is at resonance if length L is about one half of the signal wavelength in the material of substrate 104 (more precisely, $L \approx 0.49\lambda/\sqrt{\epsilon}$, where $\lambda$ is the free space wavelength). At the resonant frequency, antenna 100 radiates energy very effectively and can be easily impedance matched to the external transmission line. The bandwidth (BW) of antenna 100 is approximated by Eq. (1) as follows:

$$BW = 3.77 \times \frac{(\varepsilon - 1)Ld}{\varepsilon^2 W\lambda} \quad (1)$$

where BW is defined as the fractional bandwidth characterized by a voltage standing wave ratio (VSWR) less than 2:1 relative to the resonant frequency (see, e.g., W. L. Stutzman and G. A. Thiele, "Antenna Theory and Design," 2nd ed. 1998, Wiley, New York, Eq. 5-77, p. 215).

For planar and conformal antennas, it is desirable to make thickness d as small as possible. However, Eq. (1) indicates that decreasing d will reduce the bandwidth accordingly. For many applications, it is also desirable to make the lateral dimensions of the antenna (e.g., L and W) as small as possible without affecting the resonant frequency. This size reduction can be achieved, e.g., by increasing electric permittivity $\epsilon$. However, Eq. (1) indicates that increasing swill also reduce the bandwidth. Note that, although Eq. (1) states that reducing W will increase the bandwidth, it is typically necessary to maintain a particular aspect ratio (L/W) to obtain a specified radiation resistance and good impedance matching. Thus, the aspect ratio cannot be changed arbitrarily to improve the bandwidth.

It would be desirable to have a planar or conformal antenna that retains some of the advantageous characteristics (e.g., thin, low profile, and substantial unidirectionality) of the patch antenna, but has, at a comparable size, an enhanced bandwidth. Note also that patch antennas designed for low-frequency (e.g., <500-MHz) applications can become relatively heavy (e.g., have a weight of about one pound or more), primarily due to the relatively large size and weight of the dielectric substrate. It would therefore be desirable to reduce the physical size of such low-frequency antennas and/or the amount of (relatively heavy) substrate material used therein.

Model Antenna Structures:

Behavior of a resonant structure can be analyzed and understood by considering its natural modes of oscillation. An effective resonant antenna possesses a natural mode of oscillation that couples strongly to radiation modes. The strength of this coupling can be quantified using a parameter known as the quality factor (Q or Q-factor) of the resonant mode, which is proportional to the ratio of stored energy to radiated power. The quality factor depends on the rate at which the resonant mode transfers energy into radiation modes. A lower Q corresponds to a higher energy-transfer rate and stronger emission.

To maximize the bandwidth of a resonant antenna, it is desirable to minimize the radiation Q-factor of its resonant mode, since the bandwidth of the antenna varies inversely with the Q-factor. A real-life antenna also has some energy absorption, e.g., due to conductor or dielectric losses. Absorption losses reduce the overall Q-factor of the antenna, but also reduce the radiation efficiency of the antenna, the latter being an undesirable effect. Therefore, when we seek to minimize the Q-factor, it is the radiation Q-factor that we seek to minimize (i.e., the Q as determined solely from radiation damping of the mode). In this subsection, we assume that there is no absorption loss, such that the term "Q-factor" refers specifically to the radiation Q-factor of the mode. Then, by minimizing the radiation Q, not only do we optimize bandwidth, but also efficiency, as we insure that a larger fraction of the modal energy dissipates through radiation rather than through absorption.

To understand the behavior of a resonant antenna, we first analyze the antenna structure without the presence of a transmission line feed. The unfed structure, hereafter referred to as the resonator, possesses one or more natural modes of oscillation. Typically, it is desirable to identify a single fundamental resonant mode with a relatively low radiation Q-factor, and then utilize this mode in the operation of the antenna. The resonator structure may also possess other, higher-order modes having Q-factors higher than and radiation patterns different from those of the fundamental mode. These higher-order modes may be excited to a small degree over the operating bandwidth of the antenna. However, the properties of the antenna within the operating bandwidth are dominated by the fundamental mode.

After designing a resonator having a fundamental resonant mode with a relatively low Q-factor, the next step is to incorporate a feed into the resonator structure to enable it to function as an antenna. It is desirable for the feed to excite the resonant mode in such a manner that the transmission-line impedance can be matched to the antenna impedance. This result is achieved if the radiation resistance of the antenna has a value that is relatively close to the transmission line impedance and if the reactance of the antenna is close to zero at the matched frequency. It is known that lumped element capacitors and/or inductors can be used to assist in the impedance matching (for example, to tune the reactance to zero). The antenna impedance seen at the feed point can also be modified by appropriately changing the geometry and/or placement of the feed. It is desirable for the feed to effectively excite the fundamental mode of the resonator. When the feed is incorporated into the resonator with minimum disturbance to the resonator structure, the modal analysis performed on the unfed resonator is sufficiently accurate in predicting the operating frequency and bandwidth of the impedance-matched antenna. In some configurations, the feed structure may present geometric features that modify the modal behavior of the underlying resonator structure. In these cases, it might be helpful to incorporate certain aspects of the feed structure into the modal analysis of the resonator to better understand the antenna behavior.

Figure 2A:
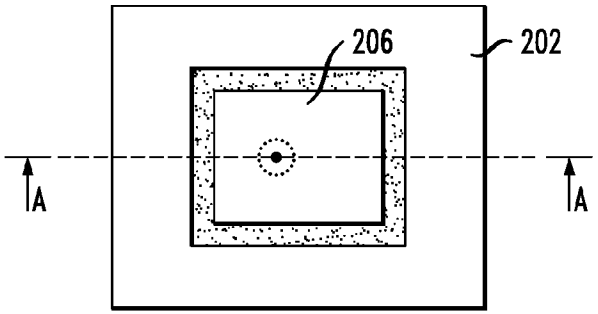
FIG. 2A PRIOR ART
FIGS. 2A-B show top and cross-sectional side views, respectively, of a model prior-art patch antenna.
Figure 2B:
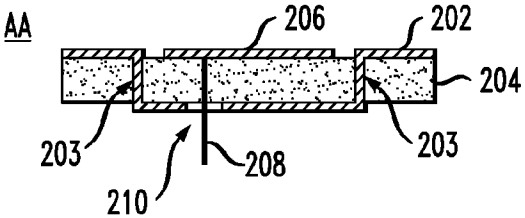
FIG. 2B PRIOR ART

FIGS. 2A-B show top and cross-sectional side views, respectively, of a model prior art patch antenna 200. Antenna 200 differs from antenna 100 in that its ground plane 202 is generally flush (i.e., coplanar) with a patch 206. Below patch 206, ground plane 202 is recessed into a dielectric substrate 208, which supports the patch and the ground plane. The recessed and flush portions of ground plane 202 (which is more accurately described by the term "ground surface" because it is not strictly planar) are electrically connected by vertical conducting walls 203. A conducting probe (wire) 208 fed through an opening 210 in the recessed portion of ground plane 202 couples patch 206 to an external transmission line (not explicitly shown). Probe 208 does not have a direct electrical contact with ground plane 202.

The resonator of antenna 200 has been analyzed using a commercially available numerical eigenmode solver implementing a finite-element method of calculation. By incorporating perfectly matched layers (PMLs) at the outer boundaries of the computation region, the eigenmode solver returns a complex oscillation frequency, which enables one to determine the fundamental resonant frequency and radiation Q-factor of the resonator. The following geometry has been used in the calculations: 4 mm thickness for substrate 204; 3.8×4.9 $cm^2$ lateral dimensions for patch 206; 5.0×6.0 $cm^2$ lateral dimensions for the recessed portion of ground plane 202, which portion is assumed to be centered below the patch; and infinite lateral dimensions for the ground plane and the substrate. The materials of ground plane 202 and patch 206 are assumed to be perfectly conducting, and the substrate material is assumed to have a dielectric constant of 2.1. With these parameters, the eigenmode solver finds a resonant mode at 2043 MHz with a Q of 32.6. If this resonator is excited by probe 208 placed about 6.5 mm off center along the long axis of patch 206, then, near the resonant frequency, antenna 200 becomes impedance matched to a 50-Ohm transmission line.

Figure 3:
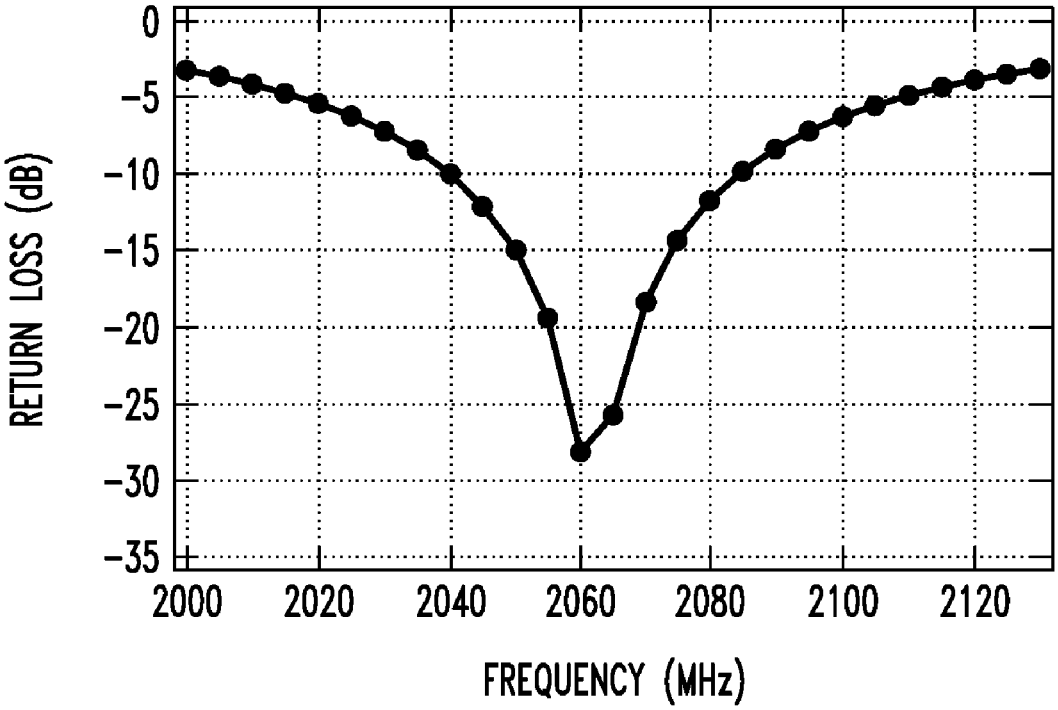
FIG. 3 graphically shows representative return loss for the antenna of FIG. 2.

FIG. 3 graphically shows experimentally measured return loss for antenna 200 implemented with the above-specified parameters. A zero dB return loss means that 100% of the power applied to the antenna is reflected back into the feed line, i.e., there is no energy loss due to energy transfer to radiation. The lower the dB value of the return loss, the higher percentage of the energy is radiated out from the antenna. As can be seen in FIG. 3, this implementation of antenna 200 has a −10-dB return-loss bandwidth of about 45 MHz, or a fractional bandwidth of about 2.2% with respect to the resonant frequency (2060 MHz). This fractional bandwidth is expected for an antenna with a Q-factor of about 30.3. By comparing the data of FIG. 3 with the results of the above-described numerical eigenmode analysis, we observe that the latter is reasonably accurate in predicting the resonant frequency and Q-factor.

FIGS. 4A-D show cross-sectional side views of four model resonators 410, 420, 430, and 440, some of which can be used to construct planar or conformal antennas according to various embodiments of the invention. The resonators of FIG. 4 are assumed to extend infinitely out of the plane of the figure. Resonator 410 (FIG. 4A) is generally analogous to antenna 100. Resonators 420, 430, and 440 (FIGS. 4B-D, respectively) represent embodiments of the invention.

Analysis of the properties of resonator 410 reveals that the relatively high Q-factor (and small bandwidth) of the corresponding patch antenna (e.g., antenna 100 of FIG. 1) results from relatively weak coupling to radiation modes. The coupling is weak because the resonant mode is predominantly trapped underneath a patch 406 and can only couple to radiation modes at the two edges of the patch as indicated by the two slanted arrows in FIG. 4A. The coupling strength is affected by the thickness and electric permittivity of the substrate that fills the space between patch 406 and a ground plane 402. A thinner substrate with higher permittivity tends to increase the isolation of the resonant mode from radiation modes, thereby increasing the Q-factor.

Figure 4A:
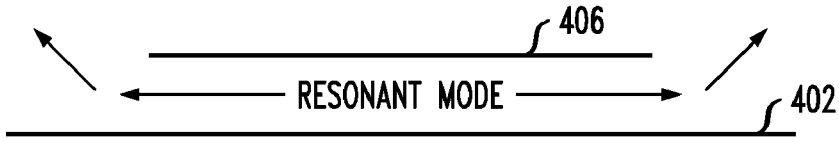
FIGS. 4A-D show cross-sectional side views of four model resonators, some of which can be used to construct planar or conformal antennas according to various embodiments of the invention.
Figure 4B:
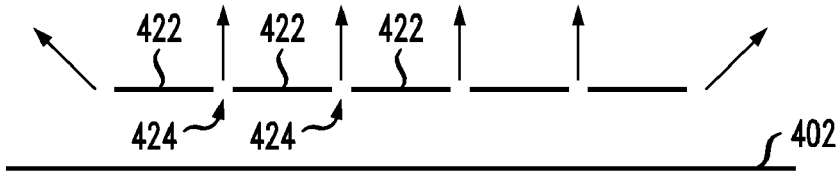

One possible way of increasing the strength of resonant-mode coupling to radiation modes is suggested in FIG. 4B. More specifically, the patch structure in resonator 420 has a series of gaps 424, from which additional energy can radiate as indicated by the vertical arrows. However, further analysis of the electromagnetic behavior of resonator 420 is necessary before one can conclude that it has a lower Q-factor than that of resonator 410. For example, one problem might be that the resonant mode in resonator 410 is characterized by an electrical current that continuously flows (back and forth) across the whole patch, whereas gaps 424 in the strip-array structure of resonator 420 prevent such current from flowing continuously. Moreover, it is not even immediately apparent that resonator 420 has a resonant frequency that is sufficiently close to that of resonator 410.

Before we analyze the electromagnetic behavior of resonator 420, it is worth mentioning that the individual widths of strips 422 and gaps 424 are less than $\lambda$ and, more typically, less than $\lambda/2$. Moreover, if the resonator has a finite number of strips 422, then the total width of all strips 422 and gaps 424 may be less than about $\lambda$ and, more typically, less than about $\lambda/2$. Therefore, the structure of resonator 420 is different from that of a conventional leaky wave antenna. More specifically, in a leaky wave antenna, a traveling wave in a bound mode leaks into radiation modes through "defects" (e.g., small slots in a rectangular waveguide) that are spaced so that the leaked radiation interferes constructively in the far-field. The latter effect is typically achieved by spacing the "defects" by about one $\lambda$. Due to this spacing, a conventional leaky wave antenna has a size larger than $\lambda$ and therefore is larger (in the relevant dimension) than resonator 420.

Figure 5A:
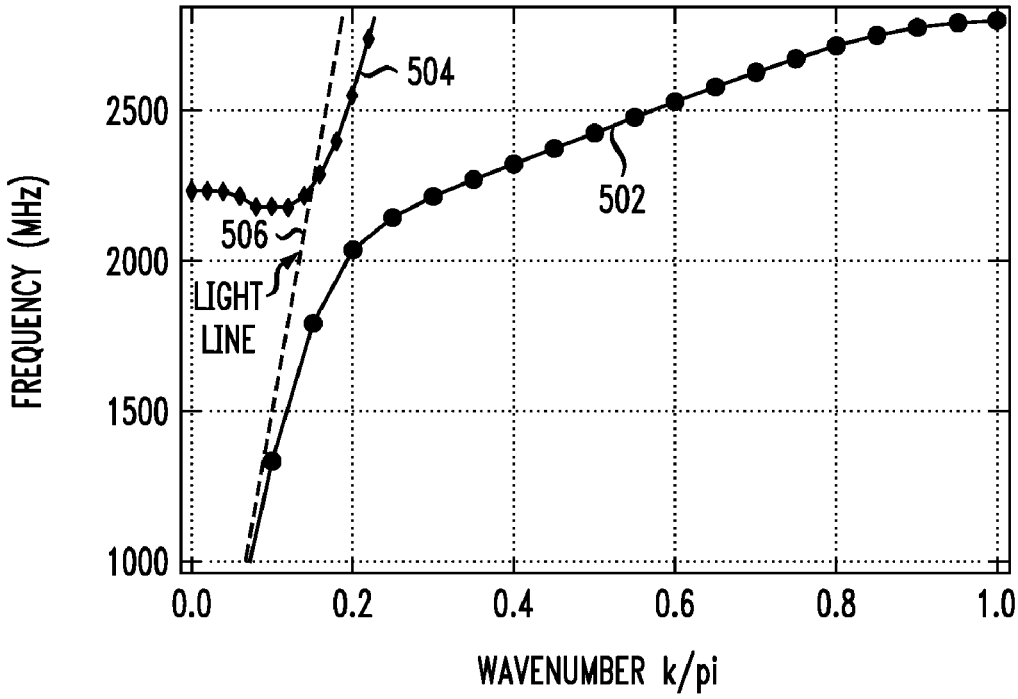
FIGS. 5A-C graphically illustrate electromagnetic characteristics of some of the resonators shown in FIG. 4.

FIG. 5A graphically shows a band diagram for resonator 420. More specifically, the band diagram of FIG. 5A corresponds to resonator 420 having an infinite periodic sequence of strips 422 and gaps 424. Each strip 422 has a width of about 0.8 cm. The spatial period is about 1.2 cm. The distance between ground plane 402 and the strip plane is about 0.4 cm, and the space between those planes is filled with a material (not explicitly shown in FIG. 4B) having a permittivity of about 25.

Curves 502 and 504 in FIG. 5A plot frequency $f(\omega/2\pi)$ versus scaled wavenumber $k/\pi$ for the modes supported in resonator 420. A dashed line 506 is the so-called "light line," which depicts the dispersion relationship ($k=\omega/c$) for waves propagating in free space. It is known that, if a mode is located above the light line, then that mode is coupled to radiation modes (and is often referred to as a leaky mode). The first band represented by curve 502 has no leaky modes. However, the second band represented by curve 504 does have leaky modes. For example, there is a leaky mode with $k=0$ at a frequency of about 2233 MHz. This mode is a fundamental radiation mode for the above-described infinite periodic strip-array structure of resonator 420.

Figure 5B:
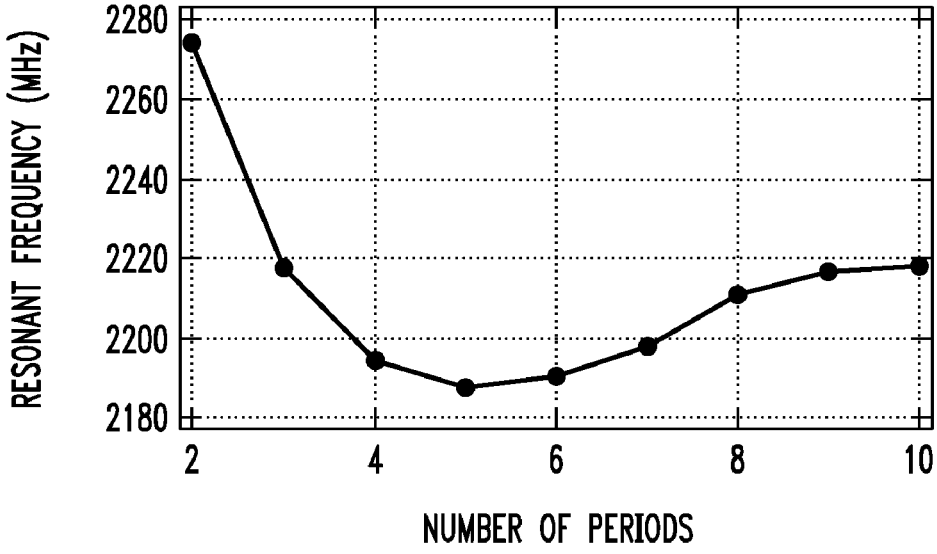

FIG. 5B graphically shows the frequency of the fundamental radiation mode as a function of the number of strips 422 in resonator 420. All of the parameters (except the number of strips 422) used to generate the band diagram of FIG. 5A were similarly used to generate the data of FIG. 5B. As the number of strips 422 is being reduced from 10 to 3, which is a 70% reduction in the total width of the patch structure, the resonant frequency varies only by ~1.5%. Thus, unlike the resonant frequency of resonator 410, the resonant frequency of resonator 420 does not depend strongly on the total width of the strip-array structure. Rather, the inductance and capacitance of a single spatial period in the strip-array structure plays the primary role in defining the resonant frequency. This property is advantageous for making relatively small (e.g., smaller than wavelength $\lambda$) antennas. For example, at 2200 MHz, the wavelength is about 13.6 cm. According to FIG. 5B, for a spatial period of 1.2 cm, the resonant frequency of resonator 420 remains substantially unchanged within the patch-width range between about ¾ and ¼ wavelength.

Figure 4C:
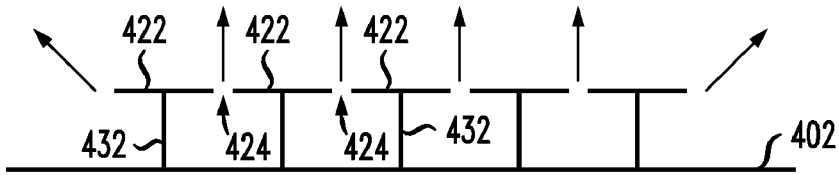

Referring now to FIG. 4C, resonator 430 shown therein is generally similar to resonator 420. However, in addition to strips 422 and gaps 424, resonator 430 has planar conducting pathways 432. Each pathway 432 electrically connects the corresponding strip 422 to ground plane 402 along the center of the strip.

Figure 5C:
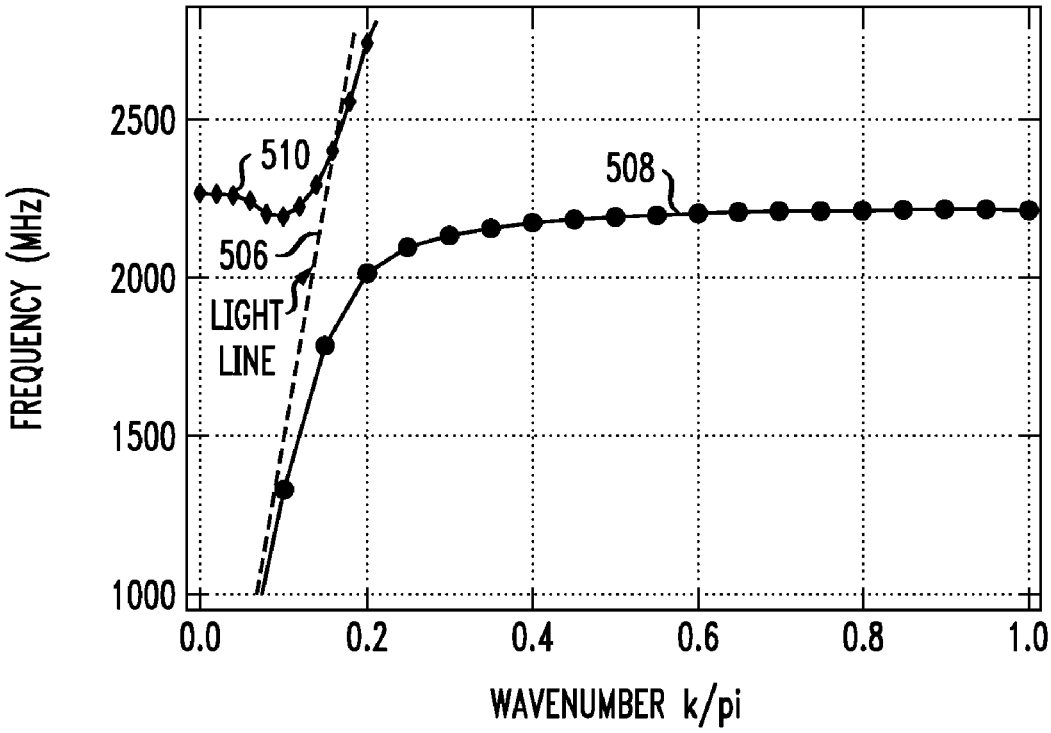

FIG. 5C graphically shows a band diagram for an implementation of resonator 430, which is generally similar to that of resonator 420 corresponding to FIG. 5A. More specifically, there is an infinite array of strips 422 having the same dimensions and relative positions as those described in reference to FIG. 5A. The space between the plane having strips 422 and ground plane 402 is similarly filled with a material (not explicitly shown in FIG. 4C) having an electric permittivity of about 25.

Referring to FIGS. 5A and 5C, the presence of pathways 432 modifies the band structure slightly. More specifically, a band 508 (having confined modes) in FIG. 5C is flatter than the corresponding band 502 in FIG. 5A. However, a radiation band 510 in FIG. 5C is very similar to the corresponding radiation band 504 in FIG. 5A. Although radiation bands 504 and 510 are similar, the difference between confined bands 502 and 508 affects the manner in which the fundamental radiation modes as well as the higher-order radiation modes (not explicitly shown in FIGS. 5A and 5C) are distributed in respective antenna structures. It may be advantageous in certain applications to both optimize the fundamental radiation mode (e.g., in band 510, the mode with k=0) as well as to minimize any negative effects of higher-order radiation modes. Pathways 432 provide a means for manipulating the higher-order modes without significantly impacting the fundamental radiation mode.

Figure 4D:
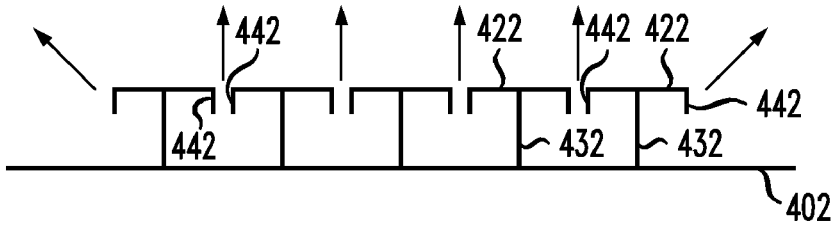

Referring now to FIG. 4D, resonator 440 shown therein is generally similar to resonator 430. However, in addition to pathways 432, resonator 440 has conducting lips 442. Each lip 442 is attached to an edge of strip 422 and extends down toward ground plane 402. Lips 442 are designed to increase both the inductance and capacitance of a spatial period, which can be used to lower the resonant frequency. Alternatively, lips 442 can be used to obtain the same resonant frequency, but using a lower-permittivity substrate. For example, if lips 442 extend halfway down toward ground plane 402 and the substrate permittivity is about 10, then resonator 440 has a resonant frequency of about 2237 MHz for a five-period structure, a value close to that of a similar resonator 430 with the substrate permittivity of about 25. Having lips 442 can be advantageous because lower-permittivity materials are generally cheaper, lighter, and lower in resistive loss than higher-permittivity materials. In addition, lips 442 can be used to reduce the amount of higher-permittivity material present in the structure, e.g., by including that material only in certain regions of the resonator, or to eliminate the substrate material altogether. The latter feature might be of interest in antennas operating at relatively low frequencies.

Figure 6:
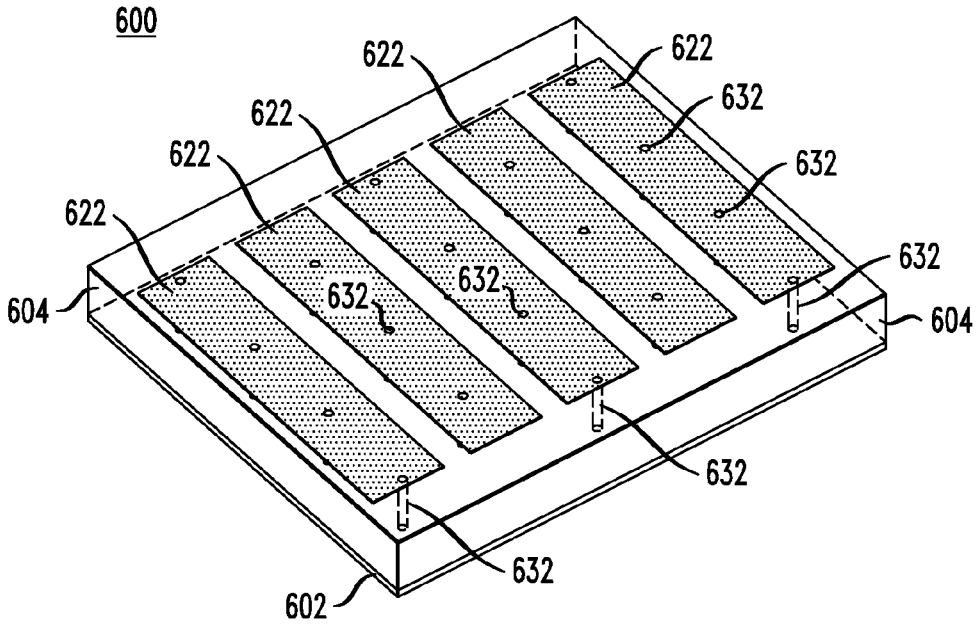
FIG. 6 shows a three-dimensional perspective view of a resonator according to one embodiment of the invention.

Strip-Array Antennas:

FIG. 6 shows a three-dimensional perspective view of a resonator 600 according to one embodiment of the invention. Resonator 600 is generally analogous to model resonator 430 (FIG. 4C). However, one difference between resonators 430 and 600 is that strips 622 (of which there are five) in the latter have a finite length. Another difference is that, instead of planar pathways 432, resonator 600 has cylindrical conducting posts 632, each connecting a respective strip 622 to a ground plane 602. While having a plurality of conducting posts 632 distributed throughout the resonator is not exactly equivalent to having a plurality of planar pathways 432, both structures have a similar effect: the resonant frequencies of higher-order modes can be controlled by changing the geometry and/or distribution of those structures. Note that, in some embodiments of resonator 600, conducting posts 632 are optional because the fundamental resonant mode has substantially the same properties with or without the conducting posts and, for some applications, target performance characteristics are attainable without direct electrical connections between strips 622 and ground plane 602.

In one embodiment, a substrate 604 of resonator 600 is part of a circuit board. Conducting posts 632 are formed using vias in the circuit board. Ground plane 602 and strips 622 are attached to opposite sides of substrate 604. Resonator 600 can sit atop a larger ground plane in a configuration similar to that shown, e.g., in FIG. 1, be recessed into a larger ground plane in a configuration similar to that shown, e.g., in FIG. 2, or be a stand-alone structure, e.g., with the size of ground plane 602 substantially matching the combined footprint of the strip array.

The above-described finite-element eigenmode simulation with PMLs placed at the outer boundaries has been used to compare resonator 600 with similarly sized model patch antenna 200 (FIG. 2). The simulations revealed that, when resonator 600 is recessed into a larger ground plane similar to that used in antenna 200, it has a radiation Q-factor of about 17-19 (the exact value depending on the specific dimensions of strips 622 and distribution of conducting posts 632) at similar resonant frequencies. Recall that antenna 200 has a Q-factor of about 33, which is nearly two times larger than the Q-factor of resonator 600.

Figure 7:
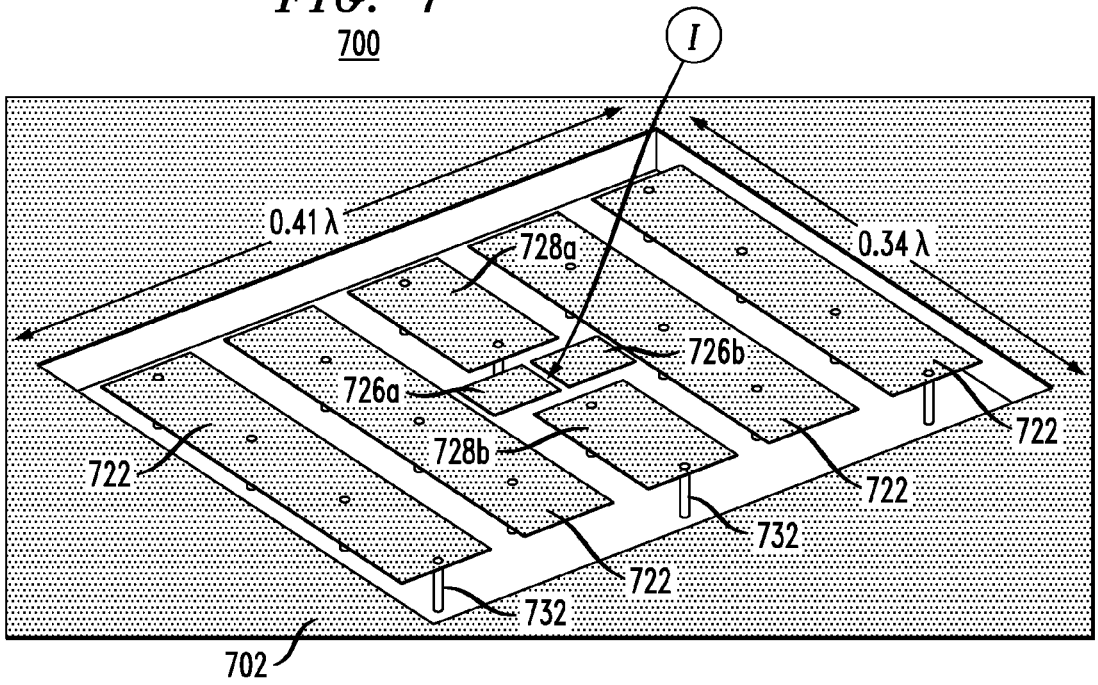
FIG. 7 shows a three-dimensional perspective view of a strip-array antenna according to one embodiment of the invention.

FIG. 7 shows a three-dimensional perspective view of a strip-array antenna 700 according to one embodiment of the invention. Antenna 700 is generally analogous to resonator 600, and analogous elements of the two devices are designated with labels having the same last two digits. However, one difference between resonator 600 and antenna 700 is that, in the latter, the center strip 722 is modified so that its middle portion is replaced by a pair of conductor plates 726*a-b*. The end portions of the center strip are labeled 728*a-b*, respectively. Ground plane 702 has a recessed portion that substantially matches the combined footprint of strips 722 and 728*a-b* and plates 726*a-b*, and is generally similar to ground plane 202 of antenna 200.

Antenna 700 is coupled to a balanced current source (I) connected to plates 726*a-b*. The balanced current source drives oscillating electrical currents in and out of plates 726*a-b* so that the electrical charges of the plates, while varying in time, remain substantially equal to each other in magnitude and opposite in polarity. When so driven, plates 726*a-b* function similar to an electrical dipole source, with its currents inducing currents in the surrounding structures and exciting the fundamental radiation mode of antenna 700. Through numerical simulation, it has been found that antenna 700 can be impedance matched to a 50-Ohm impedance by having plates 726*a-b* extend slightly beyond the line drawn through the corresponding edges of strips 728*a-b* as shown in FIG. 7. A small shunt capacitor can then be used at the feed point to tune out the excess reactance at the resonant frequency.

Figure 8A:
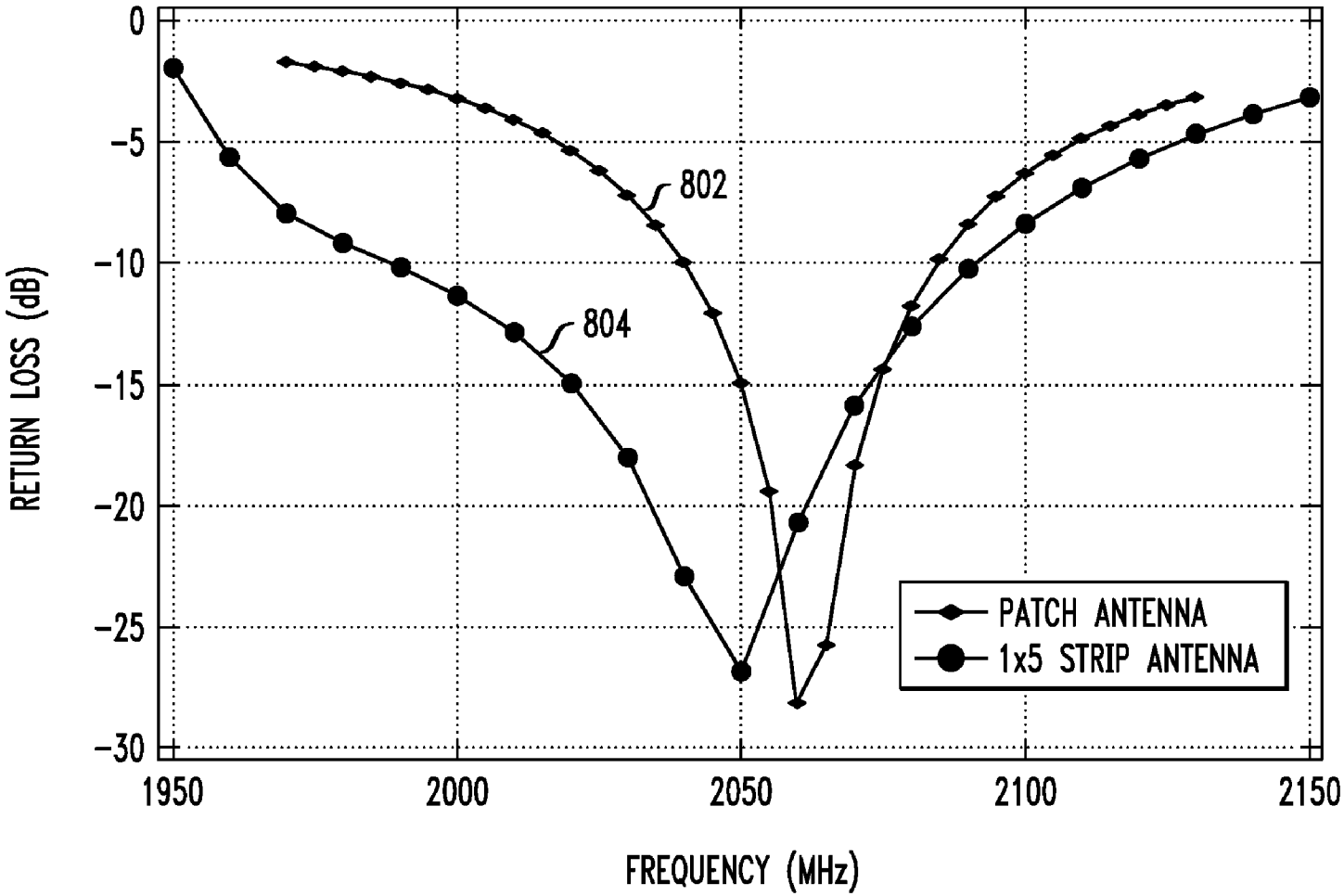
FIGS. 8A-B graphically compare return loss of similarly sized antennas of FIGS. 2 and 7.
Figure 8B:
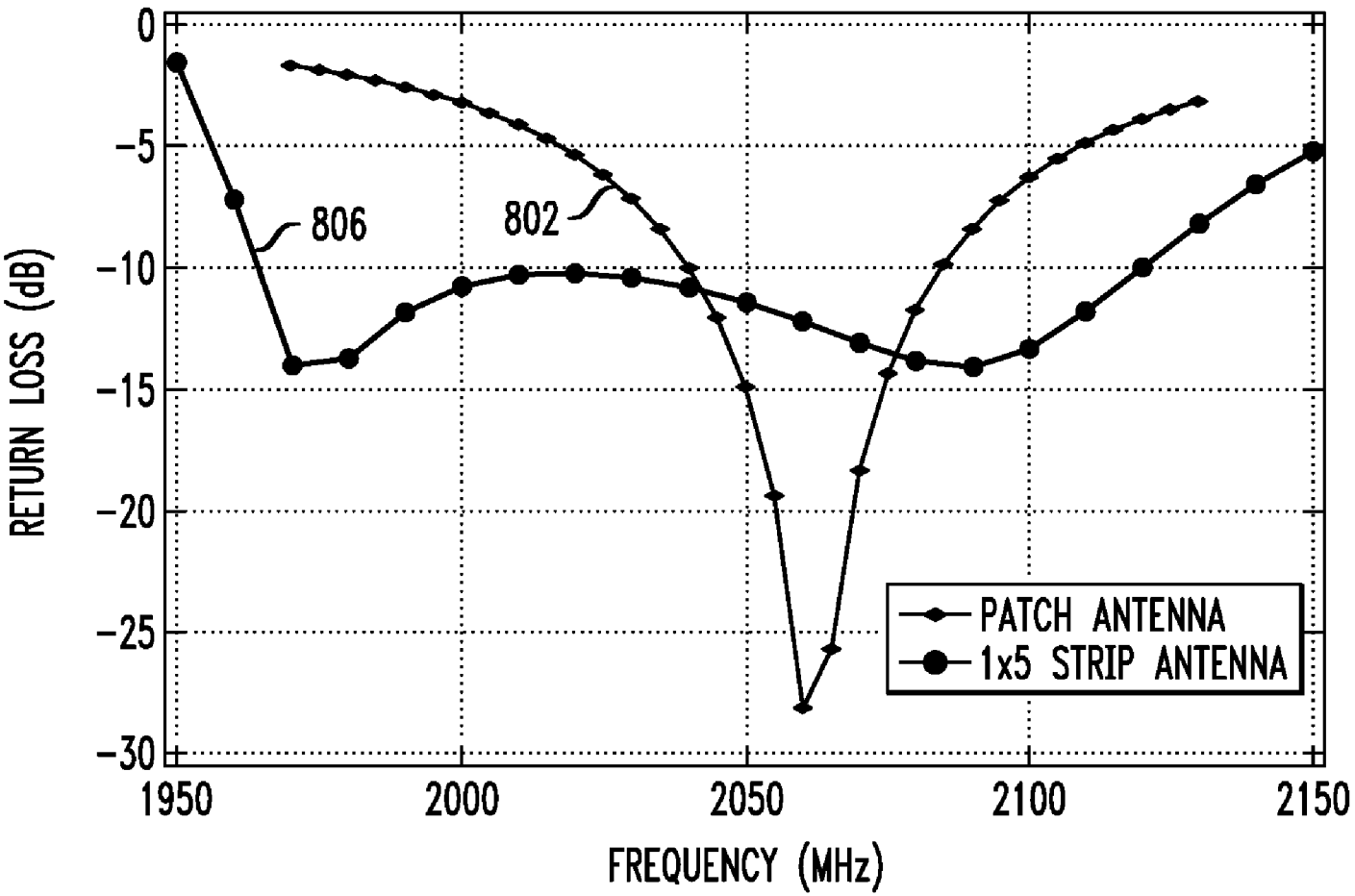

FIGS. 8A-B graphically compare return loss of similarly sized antennas 200 and 700. More specifically, a curve 802 shows return loss for antenna 200. Curves 804 (FIG. 8A) and 806 (FIG. 8B) show return loss for antenna 700 having two different shunt capacitances, 1.5 pF and 1.9 pF, respectively, placed 1.9 cm and 1.4 cm, respectively, back along a 50-Ohm transmission line from the feed point. As expected, strip-array antenna 700 has a larger bandwidth than patch antenna 200. At −10-dB return loss, the antenna configuration corresponding to curve 804 provides an approximately two-times larger bandwidth than antenna 200. Curve 806 demonstrates that, by changing the shunt capacitance and/or its location, the bandwidth can be further widened, but at the expense of having a shallower return-loss curve.

Figure 9A:
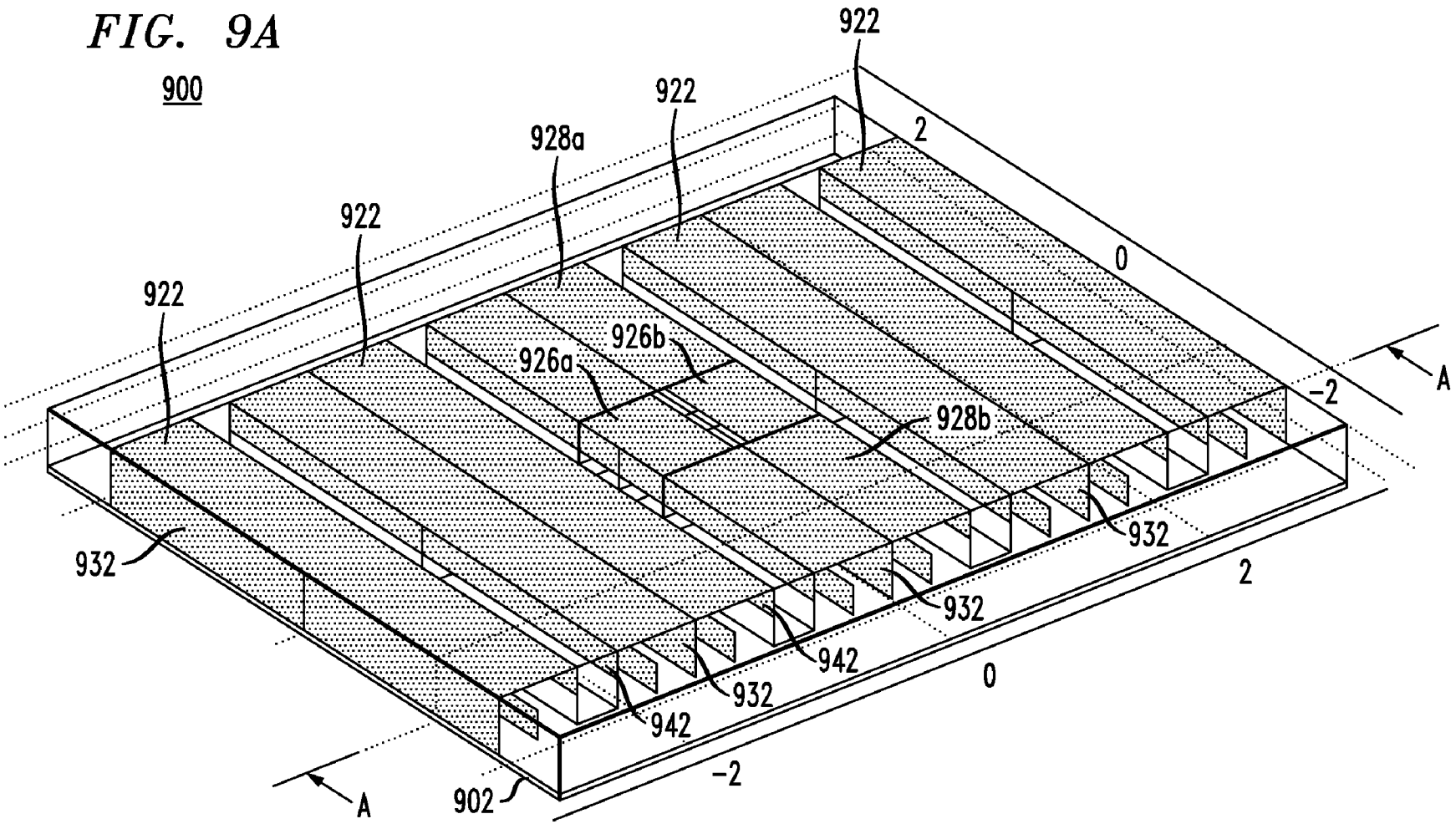
FIGS. 9A-B show three-dimensional perspective and cross-sectional side views, respectively, of a strip-array antenna according to another embodiment of the invention.
Figure 9B:
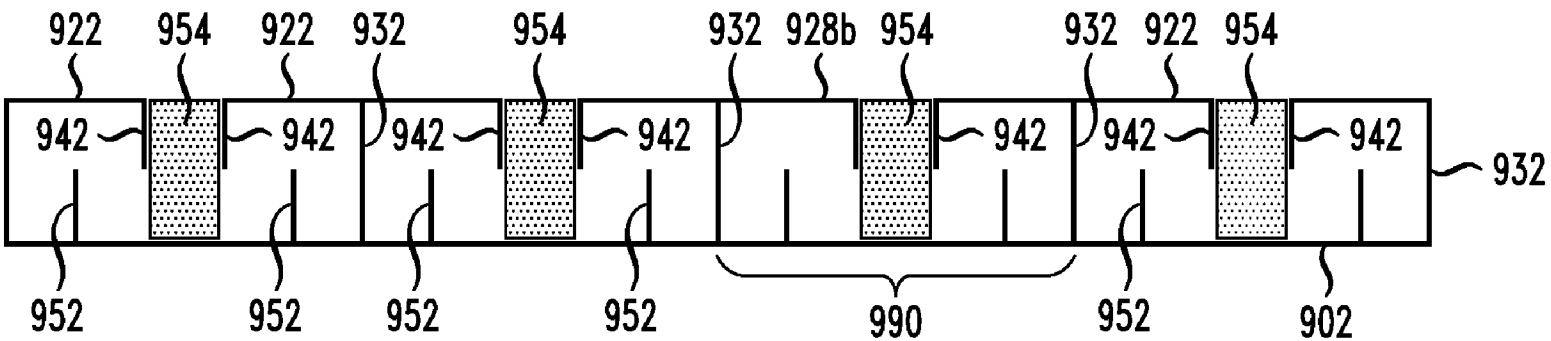

FIGS. 9A-B show a strip-array antenna 900 according to another embodiment of the invention. FIG. 9A shows a three-dimensional perspective view of antenna 900, and FIG. 9B shows a cross-sectional side view of the antenna along the plane labeled AA in FIG. 9A. Antenna 900 is generally analogous to model resonator 440 (FIG. 4D), and analogous elements of the two devices are designated with labels having the same last two digits.

In antenna 900, two outermost planar conductors 932 close up the two side gaps between ground plane 902 and the plane having strips 922. Conducting lips 942 extend from the edges of strips 922 half-way down toward ground plane 902. Planar conducting dividers 952 (for which there are no corresponding elements in resonator 440) extend from ground plane 902 half-way up toward strips 922. Blocks 954 of a solid dielectric material (e.g., substrate having a permittivity of 10.6) are inserted only into the slots between adjacent strips 922. The remaining space between ground plane 902 and strips 922 is filled with air (a permittivity of 1). The center strip 922 is divided by narrow cuts into four pieces. The end portions of the center strip are labeled 928*a-b*, respectively. The middle portion of the center strip has a pair of conductor plates 926*a-b*, which are coupled to a balanced current source in a manner similar to that of conductor plates 726*a-b* in antenna 700.

The impedance response of antenna 900 at the feed point can be fine tuned by adjusting the size and shape of the pieces connected to the balanced current source. For example, the lips connected to the edges of plates 926*a-b* can be shortened or lengthened relative to the other lips. In this manner, antenna 900 can be impedance matched to 50 Ohm without any external tuning elements.

Note that the resonator of antenna 900 is composed of four basic blocks (spatial periods) 990 (see FIG. 9B) placed side by side in a linear array. Each block 990 is a substantially rectangular conducting tube. One side of this tube has a slot oriented along the tube's longitudinal axis, with the edges of the two adjacent strips 922 framing the slot. Lips 942 are oriented substantially parallel to the longitudinal axis of the tube, are attached to the frame of the slot, and extend inward. Dividers 952 are oriented substantially parallel to the longitudinal axis of the tube and also extend inward from ground plane 902. In one embodiment, as viewed in FIG. 9B, the left divider 952 in the tube is located about halfway between the left side (planar conductor 932) of the tube and the left lip 942, while the right divider 952 is located about halfway between the right side (planar conductor 932) of the tube and the right lip 942.

In general, an antenna analogous to antenna 900 can be constructed using N blocks 900, where N is any positive integer. If a feed structure having plates 926*a-b* is employed in the antenna, then N=2 will be the smallest number of blocks 990 in the antenna. However, if a different feed structure is used, e.g., one that can be contained within a single block 990, then the antenna can be implemented with any number of blocks 990, including N=1. The choice of N depends upon the desired size of the antenna, and the target gain and bandwidth parameters. A larger N will typically lead to larger values of gain and bandwidth, but also will result the antenna becoming bigger (in λ units).

Figure 10:
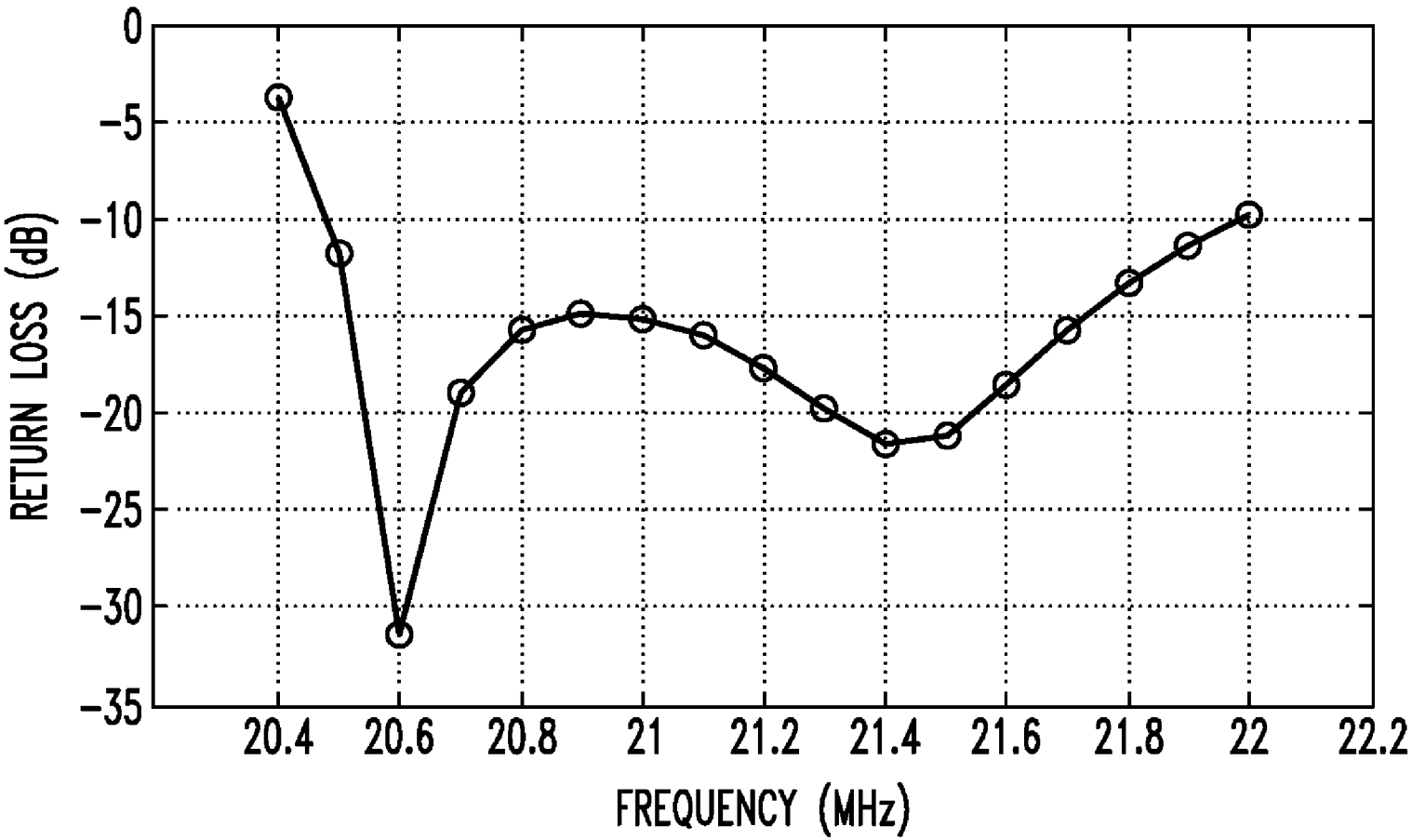
FIG. 10 graphically shows return loss for the antenna of FIG. 9.

FIG. 10 graphically shows return loss for antenna 900. As can be seen, antenna 900 has a 7% fractional bandwidth at the 10-dB level. Advantageously, this value is about three times larger than that of comparably sized prior-art patch antenna 100. An additional advantage of antenna 900 is that it has a relatively small amount of dielectric substrate material (see blocks 954 in FIG. 9) and, as a result, is relatively lightweight.

Figure 11:
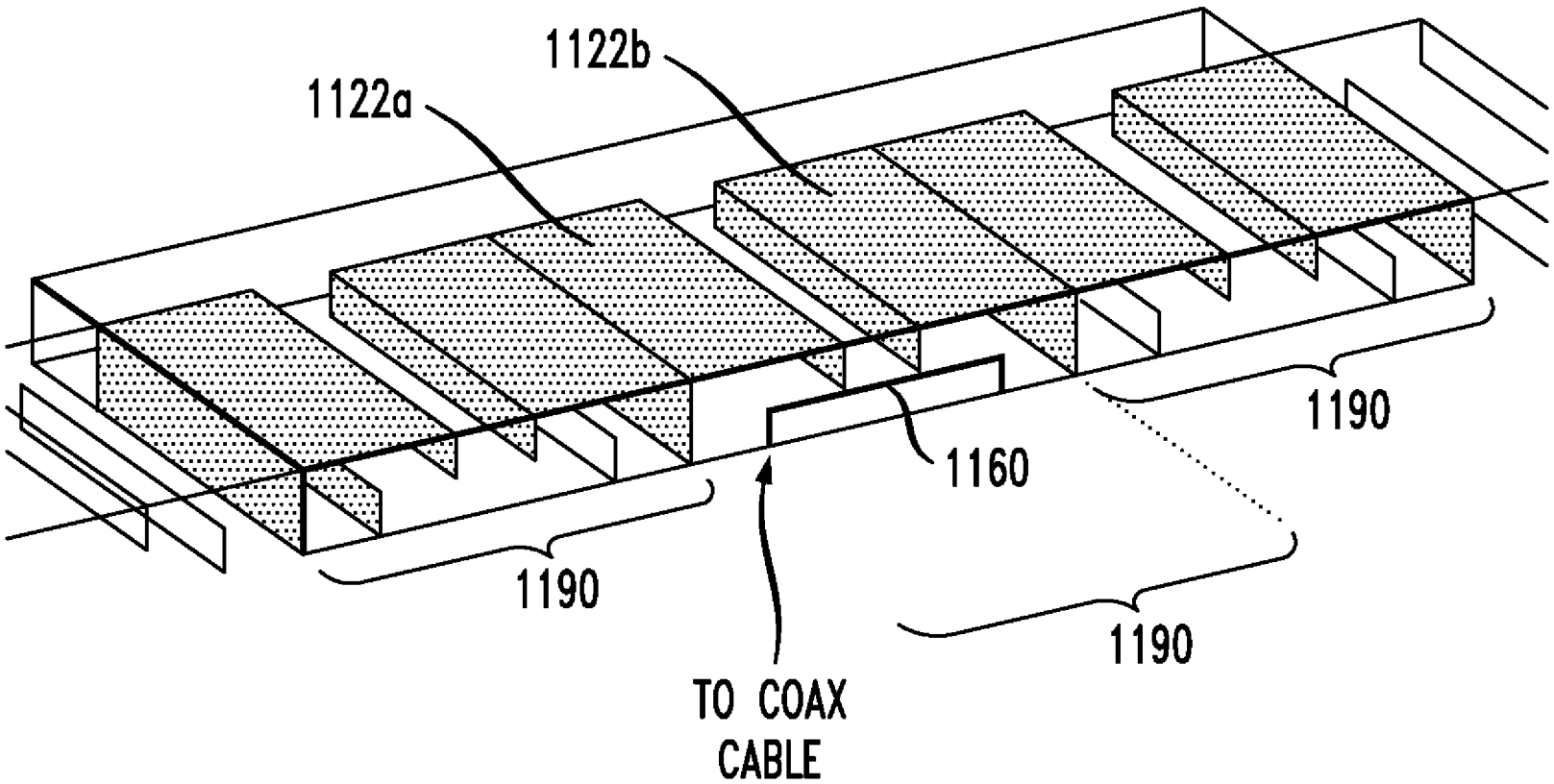
FIG. 11 shows a three-dimensional perspective cutout view of an antenna according to yet another embodiment of the invention.

FIG. 11 shows a cutout view of an antenna 1100 according to yet another embodiment of the invention. Antenna 1100 is generally analogous to antenna 900 (FIG. 9). However, one difference between antennas 900 and 1100 is that the latter is adapted to work with an unbalanced feed. In FIG. 11, the front half of antenna 1100 is cut off to show a drive loop 1160, which is located between strips 1122*a* and 1122*b* under the gap between them. An oscillating electrical current flowing through drive loop 1160 induces currents in the surrounding conducting structure, thereby exciting the fundamental radiation mode of antenna 1100. Note that drive loop 1160 is fully enclosed within the middle block 1190. Although antenna 1100 is illustratively shown as having three blocks 1190, one skilled in the art will appreciate that it can similarly be implemented with a different number of such blocks, including an implementation having just one block 1190.

In one embodiment, drive loop 1160 can be directly connected to a coaxial cable (which is one type of an unbalanced feed source), e.g., as shown in FIG. 11. If a coaxial cable serves as a signal source for antenna 900, then the feed circuitry typically incorporates a balun configured to transform an unbalanced drive signal received from the coaxial cable into a balanced signal suitable for driving plates 926*a-b*. In contrast, antenna 1100 can be driven directly from a coaxial cable or other unbalanced feed source without a balun.

Each of antennas 700, 900, and 1100 is a linearly polarized radiator, emitting a broadside radiation pattern out of its slotted surface. The transverse size of the antenna (e.g., that defined by the length of strip 722, 922, or 1122) can be selected based upon the target gain and bandwidth characteristics, and also to minimize the impact of higher-order modes/resonances on the antenna performance. The transverse size is typically chosen to be smaller than a certain threshold value, e.g., to prevent higher-order resonances from appearing altogether. The threshold value depends on the specifics of the cross-sectional profile and presence and permittivity of a substrate material. The lateral size of the ground plane affects the front-to-back emission intensity ratio in a manner similar to that of a conventional patch antenna, e.g., antenna 100.

Antennas of the invention can be implemented using a variety of techniques. The above-mentioned printed-circuit-board technique is typically used for relatively high resonant frequencies, where the physical size of the antenna is relatively small. At relatively low resonant frequencies, it may be preferred to form the antenna structures out of bent sheet metal. As used herein, the term "tube" does not necessarily imply a circular cross section, but designates a generally hollow structure, having open ends, of any cross section. The resonant frequency is determined by the particular geometry of the antenna and the permittivity of the substrate material used therein. By varying the geometry, a desired resonant frequency can be attained with different values of permittivity and, for some geometries, without using any substrate material at all. Whether to use a substrate and of what permittivity may depend upon the size and bandwidth specifications for the antenna.

An antenna may be constructed based on a selected resonator structure and by introducing a relatively small modification into that structure to accommodate the feed. FIGS. 7, 9A, and 11 illustrate exemplary approaches to incorporating the feed without significantly disturbing the resonant frequency. Other approaches are also possible. Balanced or unbalanced feeds can be used. It is also possible to place the antenna excitation source in a plane different from the top or bottom of the resonator structure. For example, dipole-source plates analogous to plates 726*a-b* (FIG. 7) can be placed above or below the strip-array plane. Probes or signal feed lines can be fed into the resonator through openings in the ground plane or using other suitable conduits.

Although antennas of the invention have been described with reference to planar antennas, they are not so limited. Conformal antennas having a non-planar sheet of conducting material as a ground base surface can similarly be constructed. The strips and plates used in such conformal antennas generally, but necessarily, follow the topology of the base sheet or surface, e.g., by having a constant offset distance therefrom throughout the antenna structure.

Although antennas of the invention have been described in reference to emitting radiation, they can similarly be used for receiving radiation. In the latter case, a corresponding drive structure (e.g., a probe or a loop) acts as a conduit that couples energy out of, rather than into, the antenna.

While this invention has been described with reference to illustrative embodiments, this description is not intended to be construed in a limiting sense. Various modifications of the described embodiments, as well as other embodiments of the invention, which are apparent to persons skilled in the art to which the invention pertains are deemed to lie within the principle and scope of the invention as expressed in the following claims.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Throughout the detailed description, the drawings, which are not to scale, are illustrative only and are used in order to explain, rather than limit the invention. The use of terms such as height, length, width, top, bottom, left, and right, is strictly to facilitate the description of the invention and is not intended to limit the invention to a specific orientation. For example, height does not imply only a vertical rise limitation, but is used to identify one of the three dimensions of a three dimensional structure as shown in the figures. Such "height" would be vertical where the strips are horizontal but would be horizontal where the strips are vertical, and so on. Similarly, while all figures show the different layers as horizontal layers such orientation is for descriptive purpose only and not to be construed as a limitation.

Also for purposes of this description, the terms "couple," "coupling," "coupled," "connect," "connecting," or "connected" refer to any manner known in the art or later developed in which energy is allowed to be transferred between two or more elements or structures, and the interposition of one or more additional elements is contemplated, although not required. Conversely, the terms "directly coupled," "directly connected," etc., imply the absence of such additional elements/structures.

I claim:

1. An antenna, comprising:

an electrically conducting surface;

an array having two or more electrically conducting strips located at an offset distance from the conducting surface, said two or more conducting strips separated from one another by one or more gaps, wherein a combined width of a conducting strip and an adjacent gap is smaller than a wavelength of a fundamental radiation mode of the antenna;

a plurality of conductors, each electrically connecting a corresponding conducting strip to the conducting surface;

a plurality of conducting lips, each attached to a corresponding strip and extending toward the conducting surface; and a pair of conducting plates adapted to excite the fundamental radiation mode, when driven by a balanced current source, wherein:

said plates are located in an opening in one of said strips; and an edge of at least one of said plates extends into a gap between said one strip and an adjacent strip beyond an edge of said one strip.

2. The invention of claim 1, wherein the total width of the array is smaller than said wavelength.

3. The invention of claim 1, wherein each of said conductors is a planar conducting pathway having a first edge attached to the corresponding conducting strip and a second edge attached to the conducting surface.

4. The invention of claim 1, further comprising a solid dielectric substrate located between the conducting surface and the two or more conducting strips, wherein each of said conductors is a via in the dielectric substrate filled with an electrically conducting material.

5. The invention of claim 1, wherein each of the conducting lips is attached to an edge of the corresponding strip.

6. The invention of claim 5, wherein at least one of the strips has two of said conducting lips.

7. The invention of claim 5, further comprising:

a plurality of planar conducting dividers, each attached to the conducting surface and extending toward a corresponding strip.

8. The invention of claim 7, wherein:

each of said conducting lips extends toward the conducting surface by about one half of the offset distance; and each of said conducting dividers extends toward the corresponding strip by about one half of the offset distance.

9. The invention of claim 1, further comprising a circuit board having a dielectric substrate, wherein the conducting surface is attached to a first side of the substrate and the two or more conducting strips are attached to a second side of the substrate.

10. The invention of claim 1, wherein:

the electrically conducting surface comprises first and second portions;

the two or more conducting strips are located at the offset distance from the first portion; and the second portion is substantially coplanar with the two or more conducting strips.

* * * * *